US008997406B2

(12) United States Patent
Vidal

(10) Patent No.: US 8,997,406 B2
(45) Date of Patent: Apr. 7, 2015

(54) MODULAR LIVING UNIT

(76) Inventor: Renato Vidal, Venice (IT)

( * ) Notice: Subject to any disclaimer, the term of this patent is extended or adjusted under 35 U.S.C. 154(b) by 0 days.

(21) Appl. No.: 14/112,930

(22) PCT Filed: Apr. 24, 2012

(86) PCT No.: PCT/IB2012/052050

§ 371 (c)(1),
(2), (4) Date: Oct. 19, 2013

(87) PCT Pub. No.: WO2012/147031

PCT Pub. Date: Nov. 1, 2012

(65) Prior Publication Data

US 2014/0033621 A1 Feb. 6, 2014

(30) Foreign Application Priority Data

Apr. 26, 2011 (IT) ..... PD2011A0131

(51) Int. Cl.

| | |
|---|---|
| ***E04B 1/346*** | (2006.01) |
| ***E04B 7/16*** | (2006.01) |
| ***E04B 1/343*** | (2006.01) |
| ***E04B 1/344*** | (2006.01) |
| ***E04H 1/12*** | (2006.01) |
| *E04B 1/00* | (2006.01) |

(52) U.S. Cl.
CPC ..... *E04B 1/34357* (2013.01); *E04B 1/3445* (2013.01); *E04B 1/344* (2013.01); *E04H 1/12* (2013.01); *E04B 2001/0069* (2013.01)

(58) Field of Classification Search
CPC ..... E04B 7/163; E04B 1/3445; E04B 1/343; E04H 15/38; E04H 6/04; E04H 15/48; E04H 1/02
USPC ..... 52/79.5, 70, 71, 64, 66, 90.1, 79.1
See application file for complete search history.

(56) References Cited

U.S. PATENT DOCUMENTS

| | | | | |
|---|---|---|---|---|
| 3,460,297 | A * | 8/1969 | Fritz | 52/66 |
| 3,714,746 | A * | 2/1973 | Barlow | 52/69 |
| 3,826,270 | A * | 7/1974 | Hentges | 280/19.1 |
| 3,942,290 | A * | 3/1976 | O'Sheeran | 52/57 |
| 3,971,185 | A * | 7/1976 | Hendrich | 52/745.14 |
| D263,818 | S * | 4/1982 | Porter | D12/103 |
| 4,479,333 | A * | 10/1984 | Hendrich | 52/70 |
| 4,630,627 | A * | 12/1986 | Windows et al. | 135/122 |
| 4,831,807 | A * | 5/1989 | Bolt | 52/641 |
| 5,069,238 | A * | 12/1991 | Marks | 135/153 |
| 5,765,316 | A * | 6/1998 | Kavarsky | 52/67 |
| 6,763,633 | B2 * | 7/2004 | Cote | 52/71 |
| 7,921,610 | B2 * | 4/2011 | Boatwright | 52/90.1 |
| 8,707,631 | B2 * | 4/2014 | Scouten | 52/66 |

FOREIGN PATENT DOCUMENTS

| | | |
|---|---|---|
| DE | 2655677 | 6/1978 |
| DE | 19800291 | 7/1999 |
| FR | 2529928 | 1/1984 |

* cited by examiner

*Primary Examiner* — Brian Glessner
*Assistant Examiner* — Paola Agudelo
(74) *Attorney, Agent, or Firm* — Themis Law

(57) ABSTRACT

An unfoldable modular living unit includes one or more folding modules having a bottom, pitched roof elements forming the roof and the side walls, and two opposing facades, front and back. Each one of the modules includes a folding and collapsible structure having two adjacent rigid sides or walls hinged to each other through a hinge or a fixed knot, a third foldable side or wall hinged to the first two rigid sides or walls, and at least one intermediate plane hinged to one of the pitched roof elements and suited to be constrained to the other pitched roof element.

10 Claims, 17 Drawing Sheets

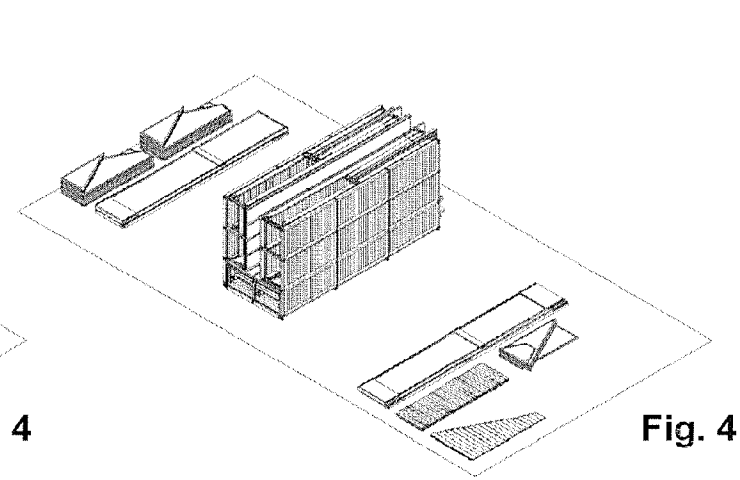
Fig. 4.1
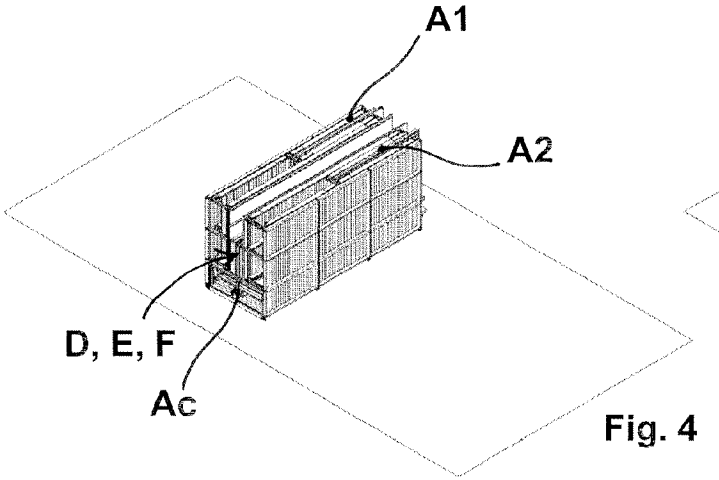
Fig. 4
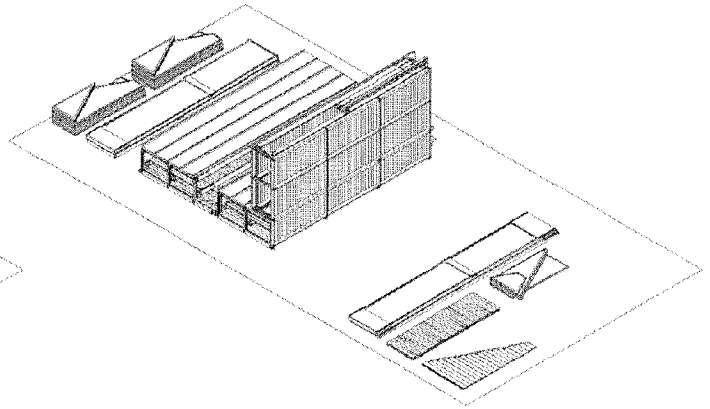
Fig. 4.3
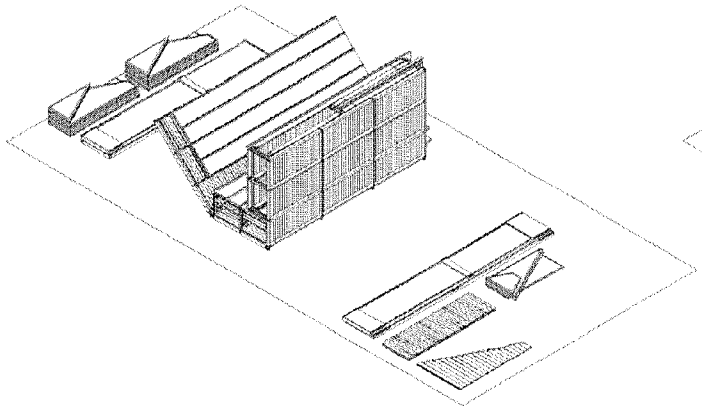
Fig. 4.2

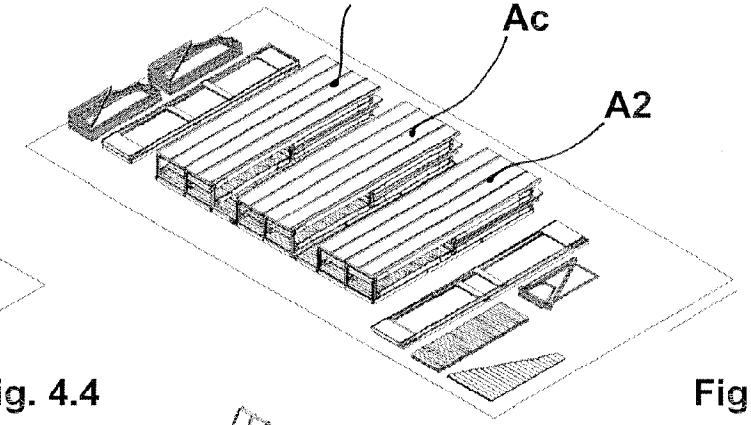
Fig. 4.4
Fig. 4.5
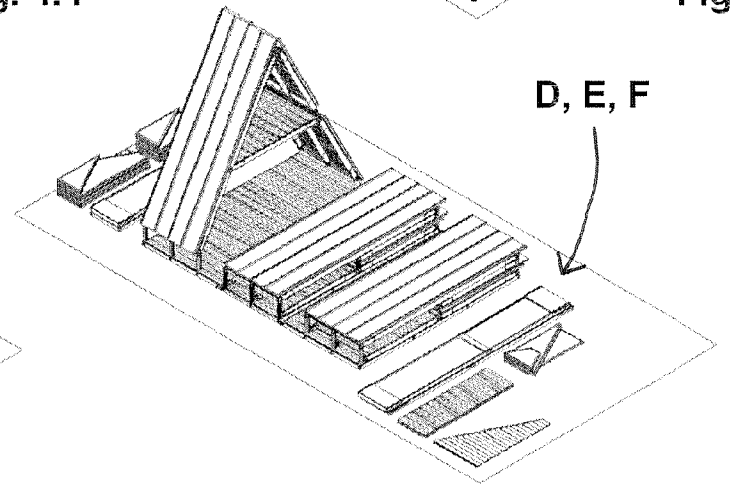
Fig. 4.6
Fig. 4.7

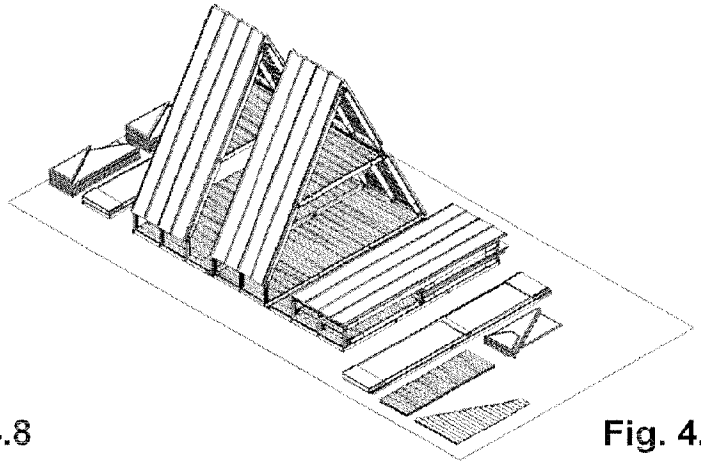
Fig. 4.9
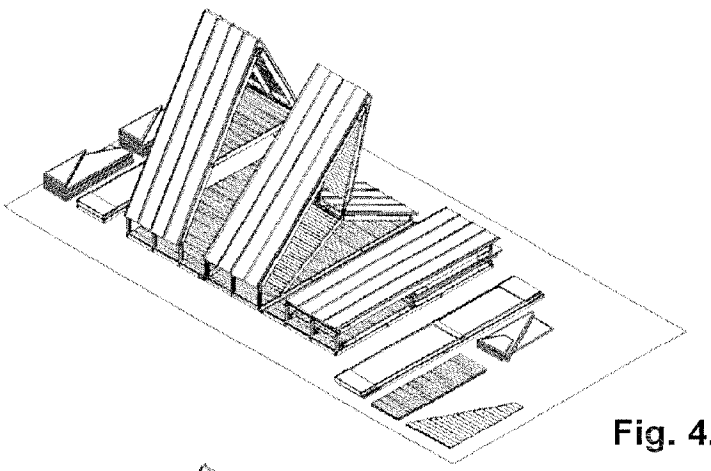
Fig. 4.8
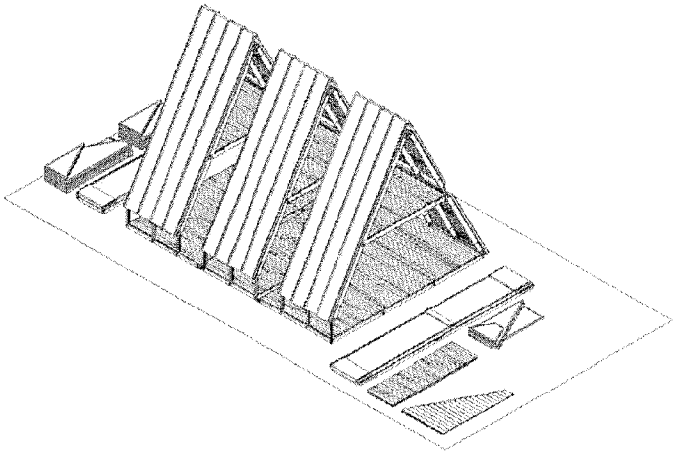
Fig. 4.11
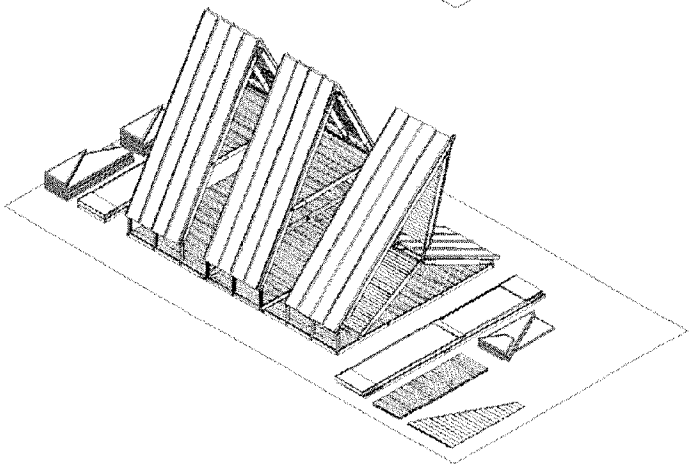
Fig. 4.10

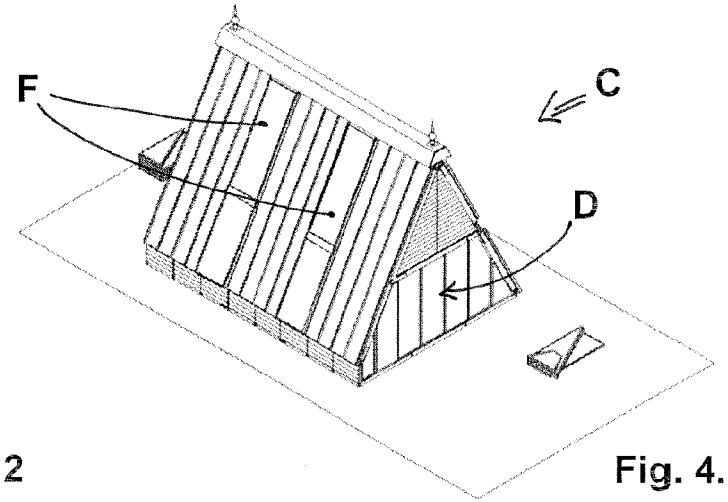
Fig. 4.13
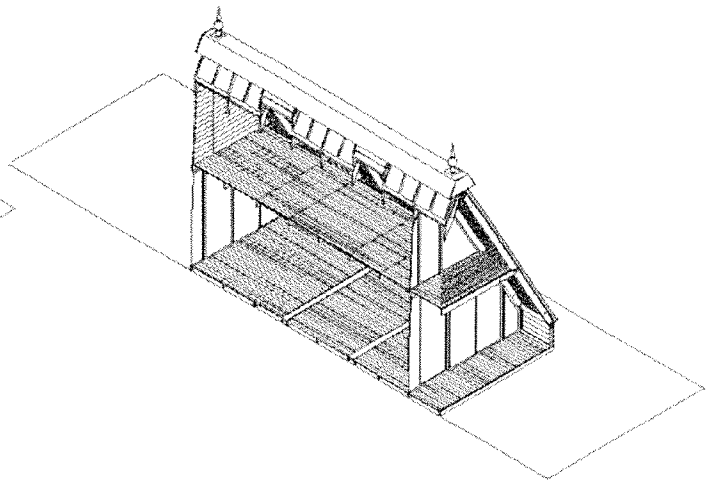
Fig. 4.15
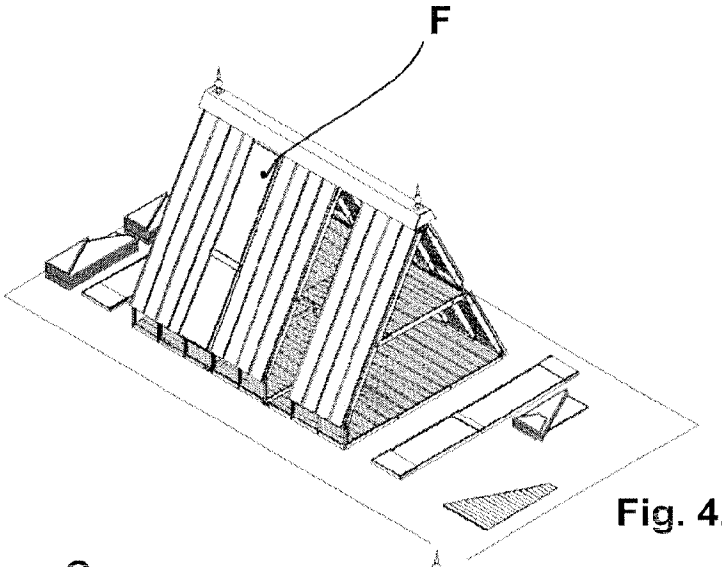
Fig. 4.12
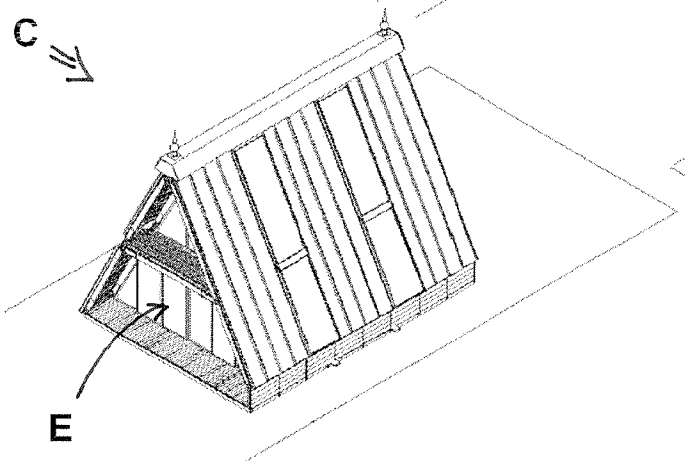
Fig. 4.14

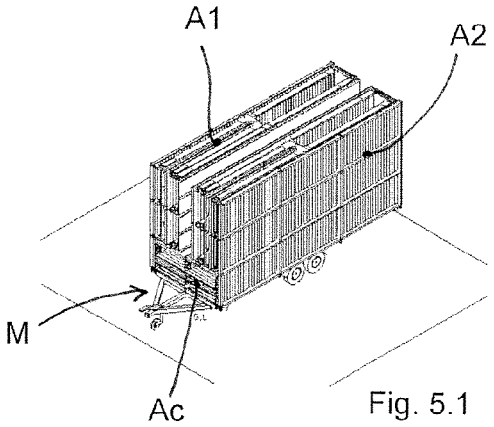
Fig. 5.1
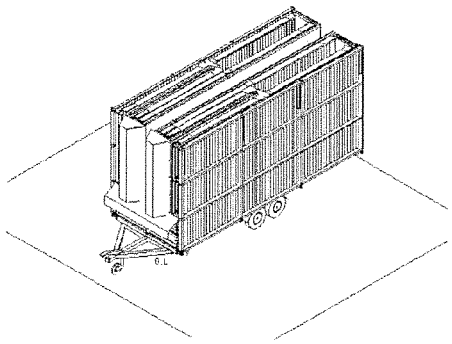
Fig. 5.2
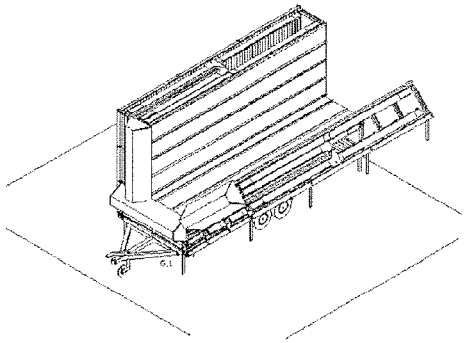
Fig. 5.3
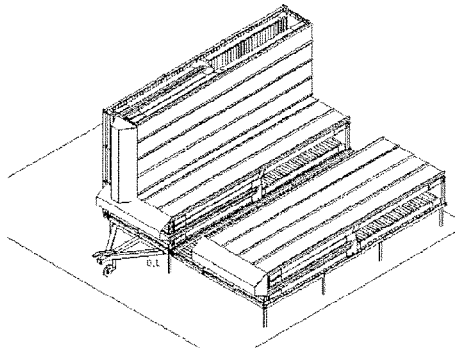
Fig. 5.4
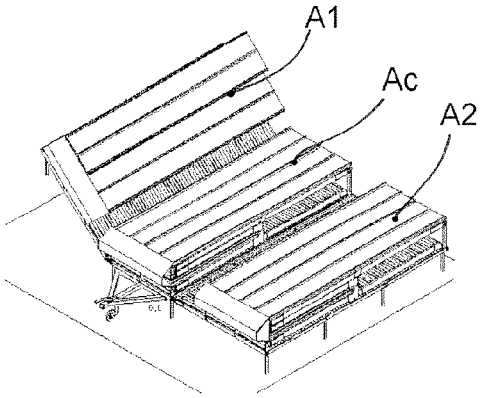
Fig. 5.5
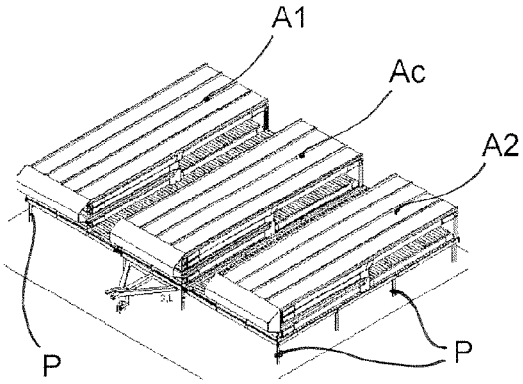
Fig. 5.6

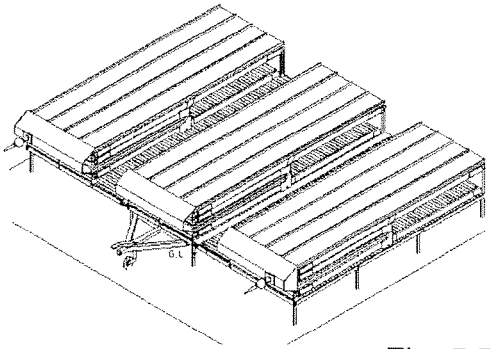
Fig. 5.7
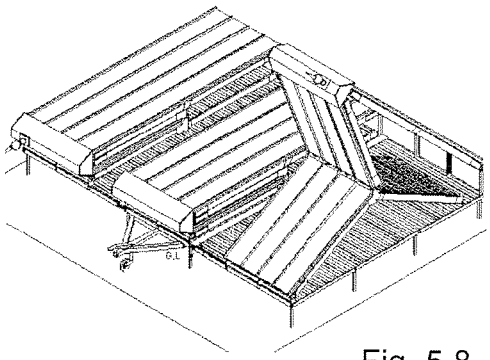
Fig. 5.8
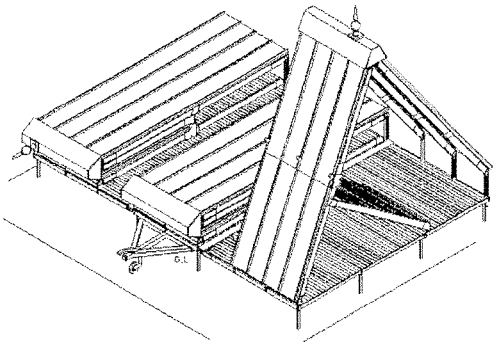
Fig. 5.9
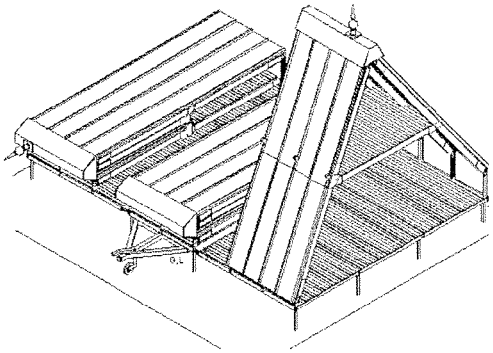
Fig. 5.10
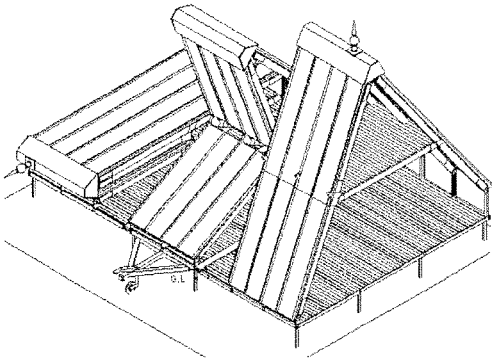
Fig. 5.11
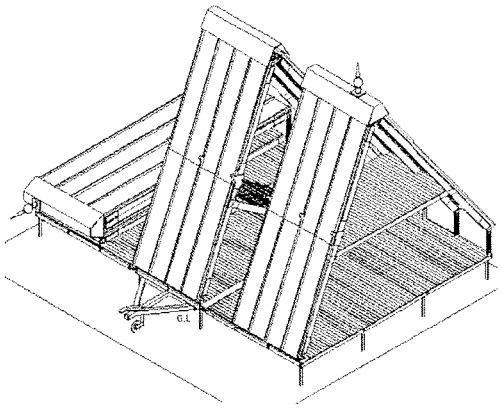
Fig. 5.12

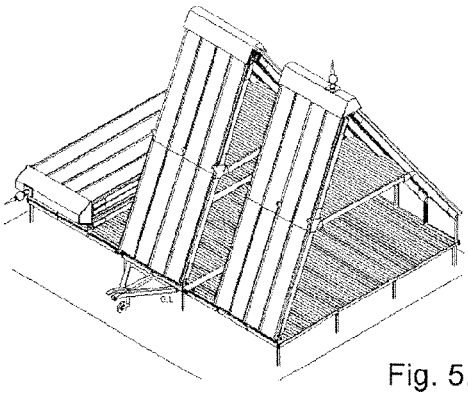
Fig. 5.13
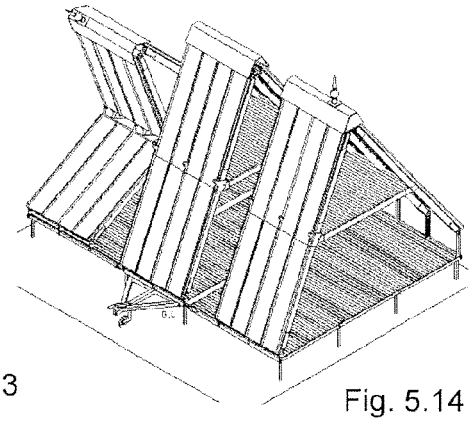
Fig. 5.14
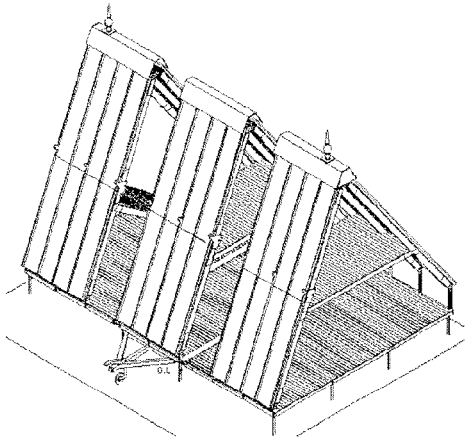
Fig. 5.15
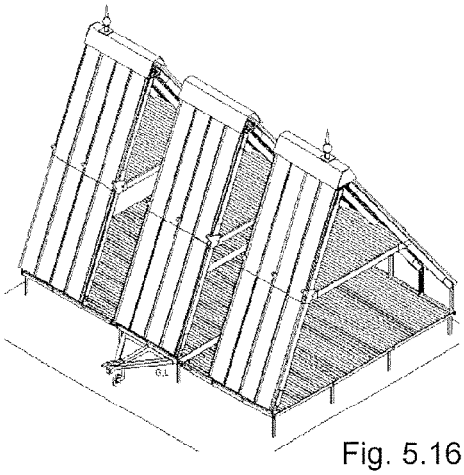
Fig. 5.16
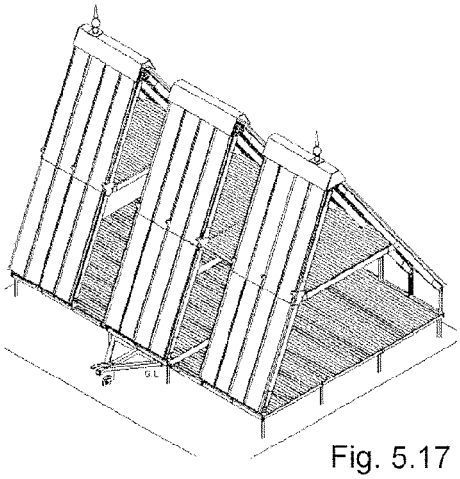
Fig. 5.17
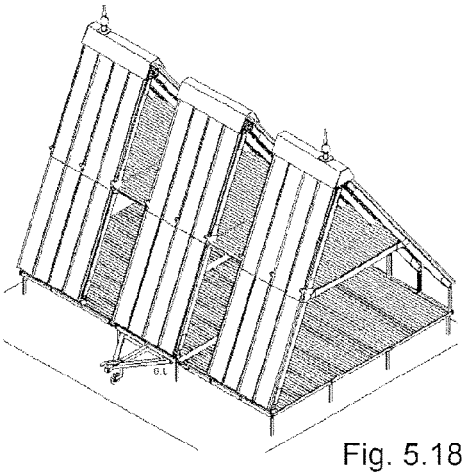
Fig. 5.18

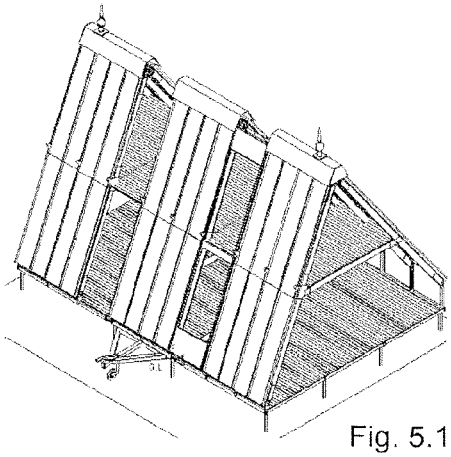
Fig. 5.19
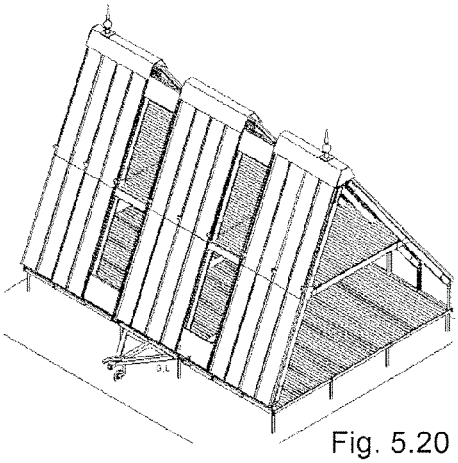
Fig. 5.20
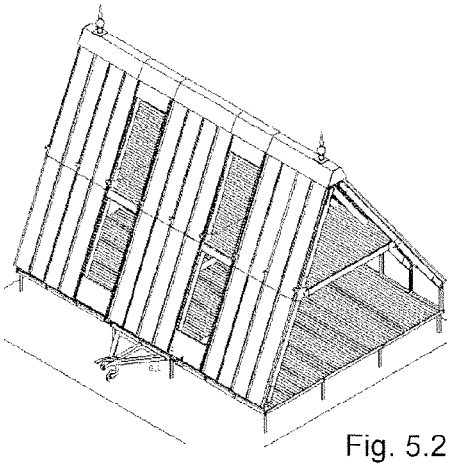
Fig. 5.21
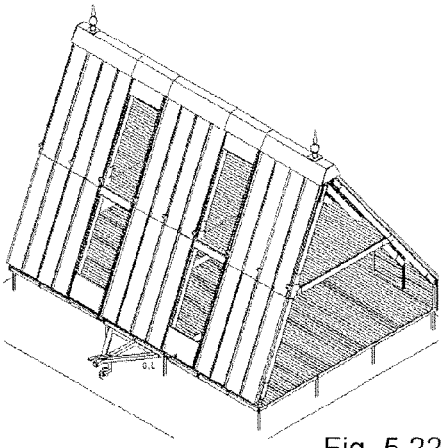
Fig. 5.22
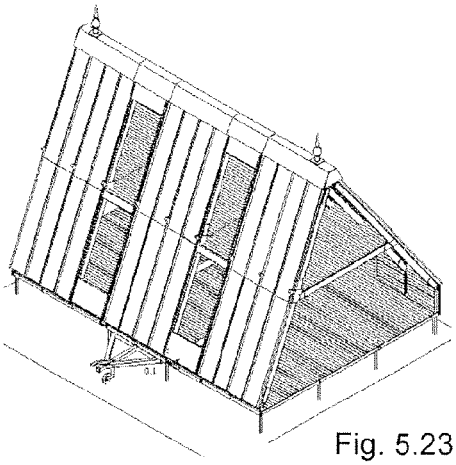
Fig. 5.23
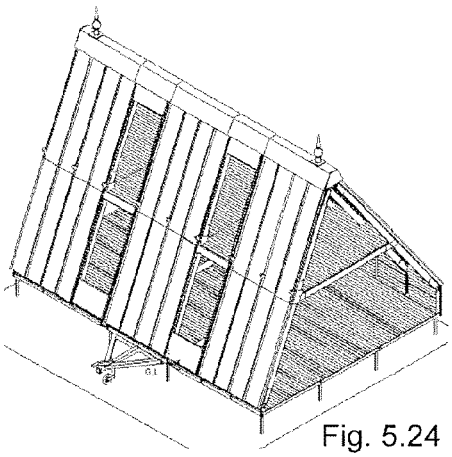
Fig. 5.24

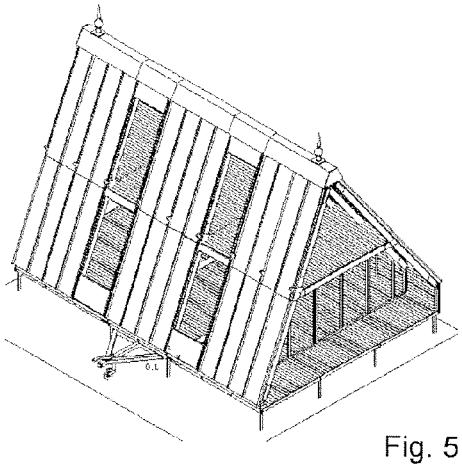
Fig. 5.25
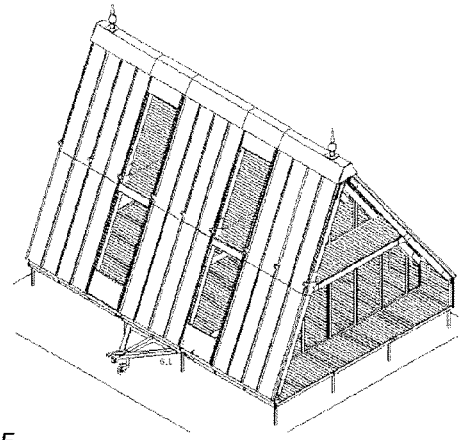
Fig. 5.26
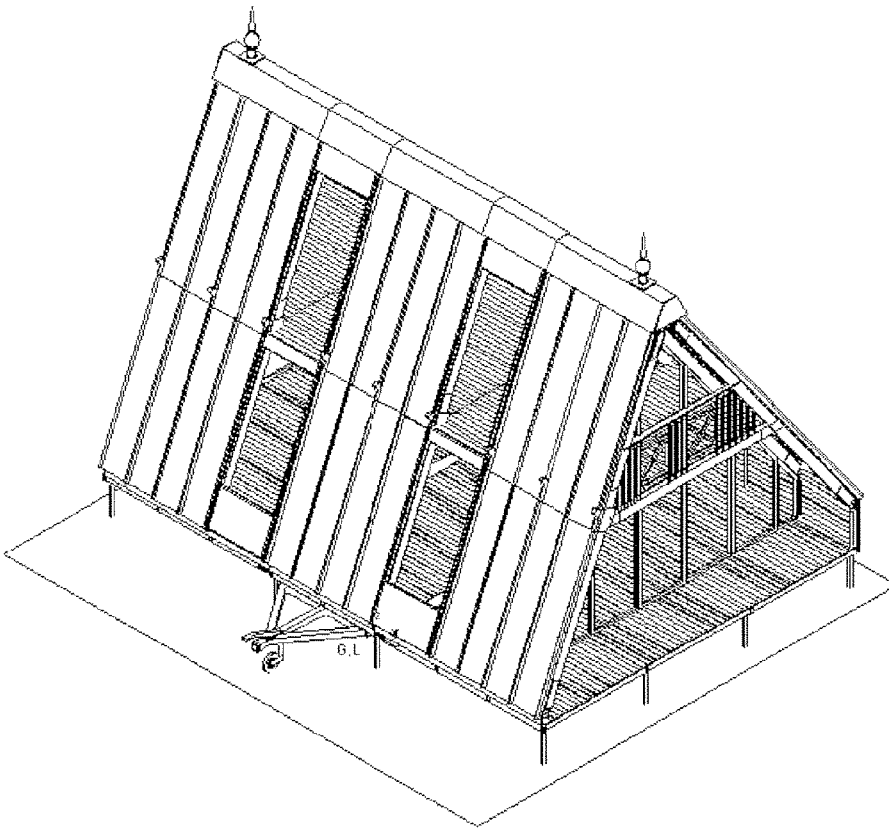
Fig. 5.27

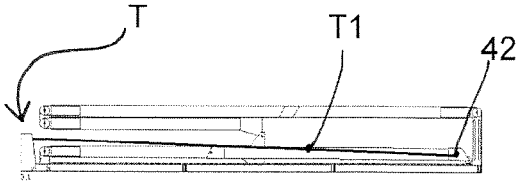
Fig. 7.1
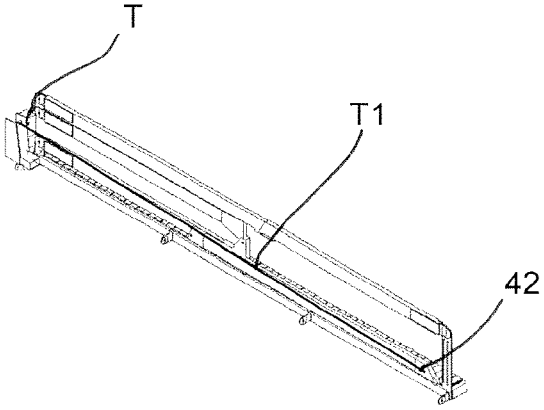
Fig. 7.2
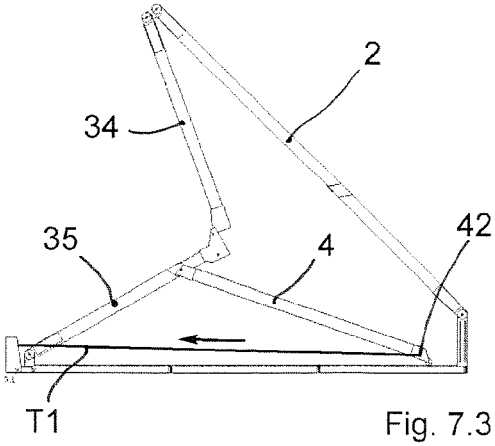
Fig. 7.3
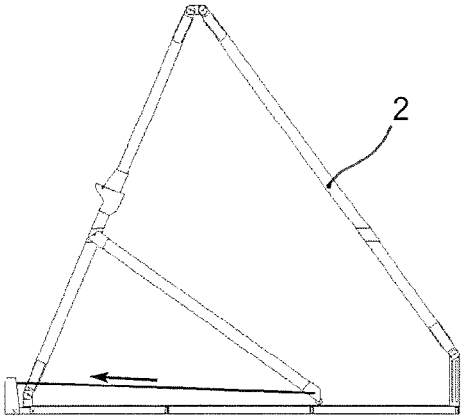
Fig. 7.4
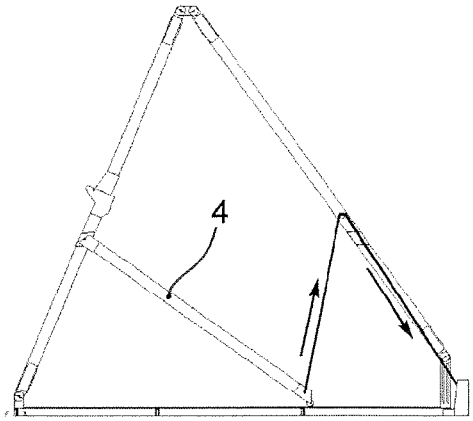
Fig. 7.5
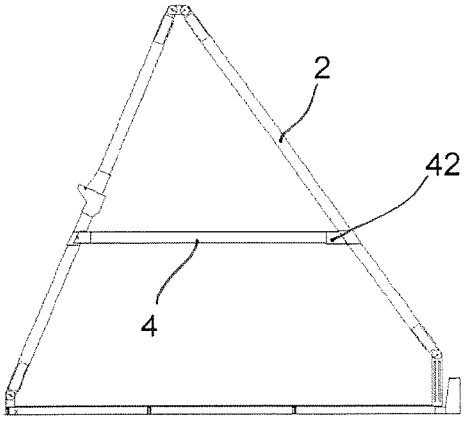
Fig. 7.6

MODULAR LIVING UNIT

The present patent concerns the sector of folding houses and in particular concerns an unfoldable and modular living unit.

Some folding and collapsible structures are known which can be used to build living units or enclosed spaces reserved for other purposes in addition to housing, for example for display purposes or otherwise.

For example foldable structures comprising a collapsible skeleton or frame suited to form a three-dimensional support structure for panels or coverings which form the walls and the roof of the house are known.

Structures with a scissor-like mechanism are also known, wherein the skeleton or frame comprises a plurality of flat meshes which define the walls, where each link is formed by rods connected to each other by hinges at the ends and centre. With three or more flat meshes it is possible to form a three dimensional structure, prismatic for example, which is easily altered that is, its configuration can be varied, widening or narrowing the walls thanks to the "scissor-like" union between the rods. In order to fix the structure it is therefore necessary to add stiffening rods. This structure is particularly suitable to construct towers, roofs, display spaces, but requires panels or covering elements which close the walls.

Unfoldable houses are known comprising a panel structure wherein when the structure is closed it has a flat shape while when it is open has a parallelepiped shape, and wherein the bottom wall and the opposite wall that forms the roof of the house are rigid panels, while the side walls are in turn foldable along a horizontal fold line substantially at half-height.

To open the house the panel forming the bottom of the house must rest on the ground, the panel forming the ceiling is lifted thereby causing the unfolding of said side walls, initially folded inwards.

The dimensions of width and depth of the house are determined by the size of the panels forming the bottom and the ceiling, which is limited by transport requirements. Consequently the height of the module is also limited because the folded walls have a height equal to the width of the panel.

Prefabricated homes are also known, commonly used to make a house available immediately in the event of natural disasters or emergencies. These houses are typically transported and put in place already assembled and therefore require special means of transport and means for installation.

The object of this patent is a new type of unfoldable modular living unit.

The main aim of the present invention is to simply and rapidly construct a modular living unit of any size, depending on the needs of the client. The construction of the new living unit foresees the unfolding of one or more modules which can be done manually, through the use of electromechanical and/or hydraulic and/or pneumatic devices for the motorized opening/closing or by using machines for the lifting of materials.

Another object of the present invention is to not require a foundation or other fixed structures, except for a level and stable support surface.

Another object of the present invention is that it can be transported without the use of exceptional means of transport and stored in a compact way.

Another object is to be modular, being made up of one, two or more adjacent modules.

For example, it is possible to arrange single-family living units, as well as stands or large storage structures for trade fairs.

In addition, the living unit made up of one or more of these new modules side by side can be expanded in a short time by simply adding additional living modules.

Another advantage of the present invention is to provide increased useable surface area by introducing additional stories.

In fact, considering the volume transported, the new living module may create more than three times its volume and more than four times the useable surface area compared to the prefabricated living modules of the known type, such as containers, caravans, etc.

The new living module can also be internally customized and equipped with facilities, equipment and furnishings maintaining the characteristic of being unfoldable and collapsible.

Another object of the present invention is that it can be assembled dry.

These and other aims, direct and complementary, are achieved by the new unfoldable modular living unit comprising in its main parts one or more modules, wherein each module comprises a collapsible and foldable structure with a substantially flat shape when folded, while when it is unfolded has a prismatic shape with a substantially triangular section, that is, with two pitched roof elements hinged together at the top and a bottom which forms the base of the triangle section.

In particular, said structure may be a panel type, where each pitched roof element and the bottom are formed by one or more panels hinged to each other, or said structure can be composite, formed of frames and wall panels, comprising at least two substantially triangular frames, crossbeams and wall panels.

In particular each module includes two rigid sides hinged to each other through a hinge or a fixed knot, while the third side of the triangle, which is hinged to the first two sides, is foldable.

The module is openable, rotating the two rigid sides around the fixed hinge and unfolding the third side toward the outside. Vice versa, the module is closable by folding the third side inwards and rotating the two rigid sides around the fixed hinge until they are mutually parallel, in a position of minimum bulk.

According to a first embodiment, the new living module is unfoldable in a fan shape, comprising one of the single-piece pitched roof elements and the single-piece bottom, directly or indirectly hinged along one edge at the lower edge of the pitched roof element.

In contrast, the second pitched roof element is foldable, that is, comprising two parts hinged together and also hinged respectively to the first pitched roof element along the top and to an edge of the bottom.

The opening of the module foresees placing the bottom on the support surface, forming the base of the triangle, lifting the first single-piece pitched roof element by rotating it with respect to the bottom, while the two parts of the two-piece pitched roof element are rotated until they are coplanar forming the second pitched roof element plane.

In contrast, the closure of the module foresees folding the two-piece pitched roof element towards the interior of the triangle and rotating the single-piece pitched roof element to bring it close to the bottom so as to form a flat structure where the pitched roof element, the bottom and the panels forming the second pitched roof element are all parallel to each other.

The closed structure can then be stacked with other structures and transported easily. By combining two or more of these living units a long modular living unit where the module is the length of the pitched roof elements and the bottom can be formed.

The unit also comprises two opposite front and back façades, each consisting of one or more assemblable walls.

The unit can be used for residential purposes, first aid in the case of natural disasters, for leisure time, for the community or even for recreational activities.

The new living module may be made of any material suitable for the purpose, for example wood, plastic, metal, or glass.

It is also possible to foresee the use of solar panels for example to cover or constitute in whole or in part the pitched roof elements or any coupling panels between the living modules.

The new living unit can be installed directly on a general support plane or on a "mobile home" type, that is, comprising a carriage with a support surface for the living unit, wheels for transport, possibly steer wheels, and hooking systems for towing.

The characteristics of the new modular living unit will be better clarified by the following description with reference to the drawings, attached by way of non-limiting example.

FIGS. 1, 2 and 3 show an embodiment of a module (A) with a fan-shaped opening, while FIGS. 3*a*-3*n* show the mode of assembly of a living unit consisting of two fan-shaped modules (A).

FIGS. 4.1-4.15 show the mode of unfolding of a living unit (C) formed by three fan-shaped modules (A), integral with each other and folded occupying a compact total volume (FIG. 4).

FIG. 4.15 shows a section of the living unit assembled (C) as in FIGS. 4.13 and 14.14.

FIGS. 5*a* and 5*b* show the new living unit (C) folded and portable as a mobile home, comprising a foldable support carriage (M) with wheels (M1) and hooking system (M2) for towing vehicles in general. FIGS. 5*c* and 5*d* show the new living unit (C) with towing vehicle (M3) and support base (M4) integral with the living unit (C) itself or functional only for the transport the same. FIGS. 5.1-5.27 show the method of unfolding a living unit (C) formed by three fan-shaped modules (A), mounted on a carriage (M).

Figure 7:
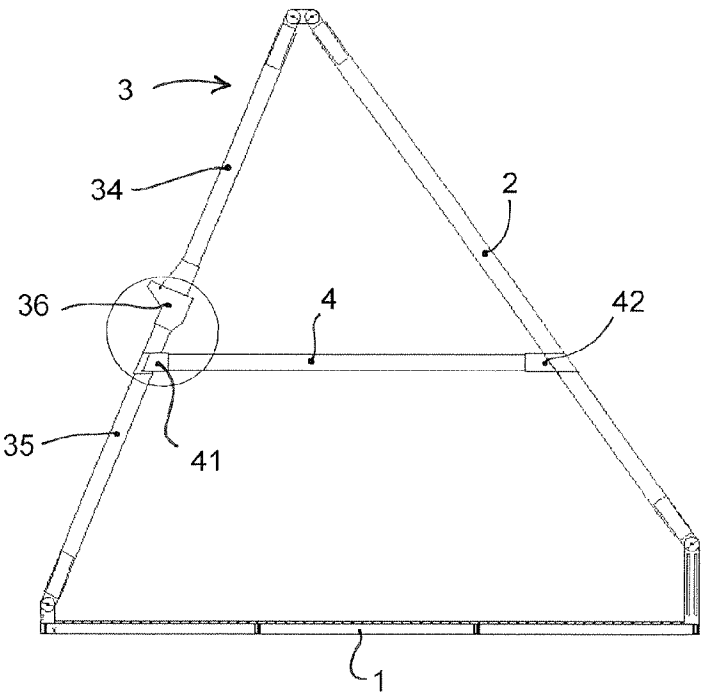
FIG. 7 shows a module (A) with the intermediate plane (4) hinged to a pitched roof element (3) in a different position from the folding hinge (36).

FIGS. 7.1-7.6 show the technique to open the module (A) using a pull-cord system (T).

Figure 8:
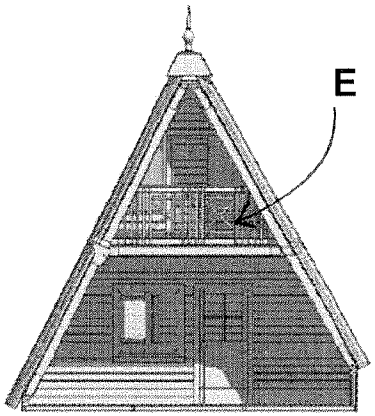

FIG. 8 shows a view of the front end (D, E) of a living unit.

Figure 10:
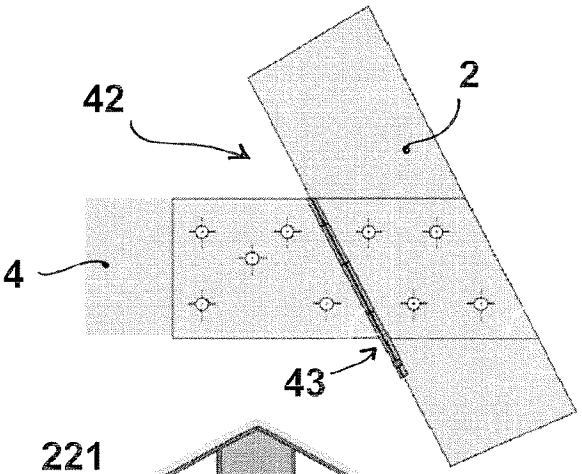
Figure 9:
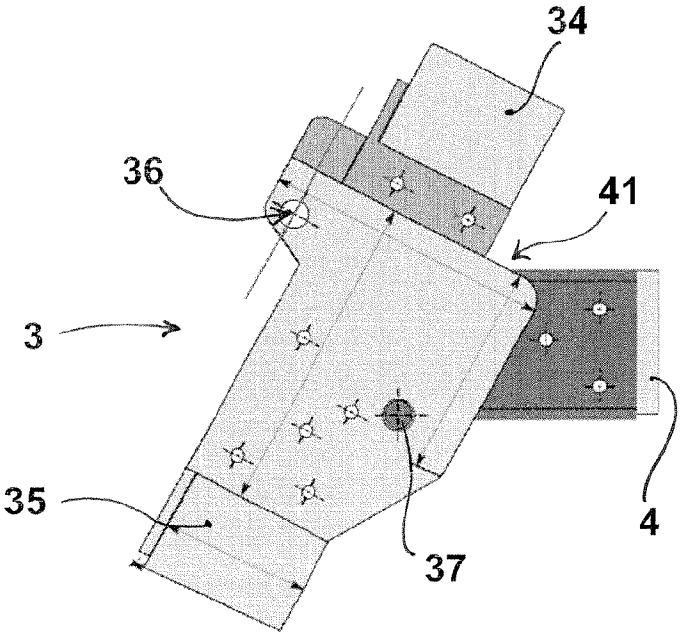

FIGS. 9, 10, by way of non limiting example, show two hinges respectively.

FIG. 11, again by way of non limiting example, shows a hinge at the top (22) in the fan-shaped solution of the module (A).

The new foldable modular living unit includes in its main parts one or more folding modules (A), each in turn comprising a folding and collapsible structure of substantially flat shape when it is closed (FIG. 1), and of a prismatic shape with triangular section when it is open (FIG. 3), that is, with two pitched roof elements (2, 3) hinged together at the top and forming two walls and roof of the house and a bottom (1) which forms the base of the triangle section and the ground floor of the home.

This structure may be a panel type, where each pitched roof element and the bottom are formed by one or more panels hinged to each other.

In the preferred embodiment, this structure is composite, formed by frames and wall panels, comprising at least two substantially triangular frames, stiffening crossbeams and wall panels.

Figure 1:
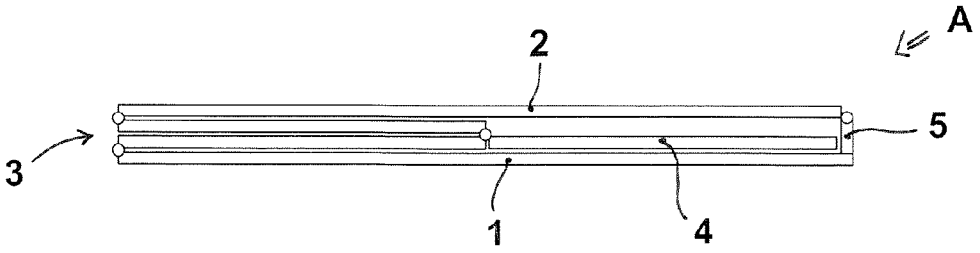
Figure 2:
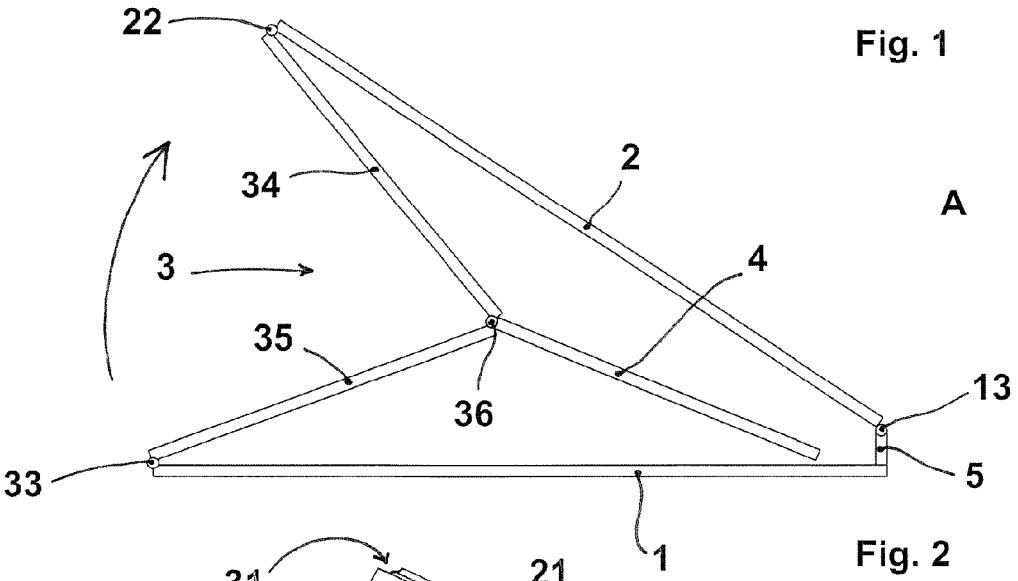
Figure 3:
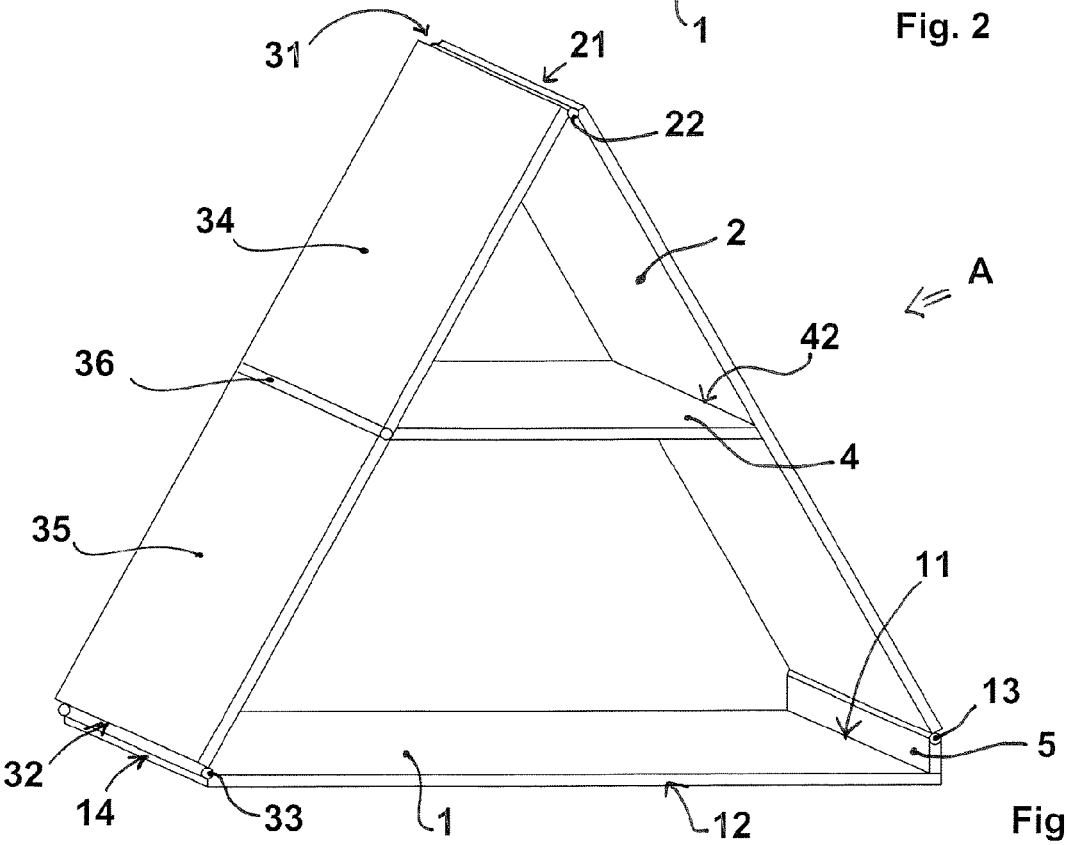

According to a first embodiment, shown in FIGS. 1, 2 and 3, this living module (A) is openable and closable in a fan shape.

The new living module (A) comprises:

- a plane bottom (1) in a substantially rectangular shape, wherein two opposite sides, for example the long sides (12), determine the width of the module, while the other two opposite sides, for example the short sides (11), determine the length of the module,
- a first pitched roof element (2) in a substantially rectangular shape, directly or indirectly hinged to a short side (11) of the bottom (1), by means of hinges (13) positioned with the axis of rotation parallel to the same short side (11),
- a second pitched roof element (3) in a substantially rectangular shape hinged with one of its short sides (31) to a short side (21) of the first pitched roof element (2) and with the opposite short side (32) to the short side (14) of the bottom (1), by means of hinges (22, 33) positioned with the axis of rotation parallel to the same short sides (31, 32).

The second pitched roof element (3) is foldable, that is, it in turn is divided along its height into at least two plane parts (34, 35) hinged together along hinges (36) parallel to the short sides (31, 32). In particular, the second pitched roof element (3) is preferably divided into two equal parts (34, 35).

The new living module (A) also comprises at least one intermediate plane (4) that divides the height of the module. This intermediate plane (4) is composite, formed of a frame and wall panels.

Figure 6:
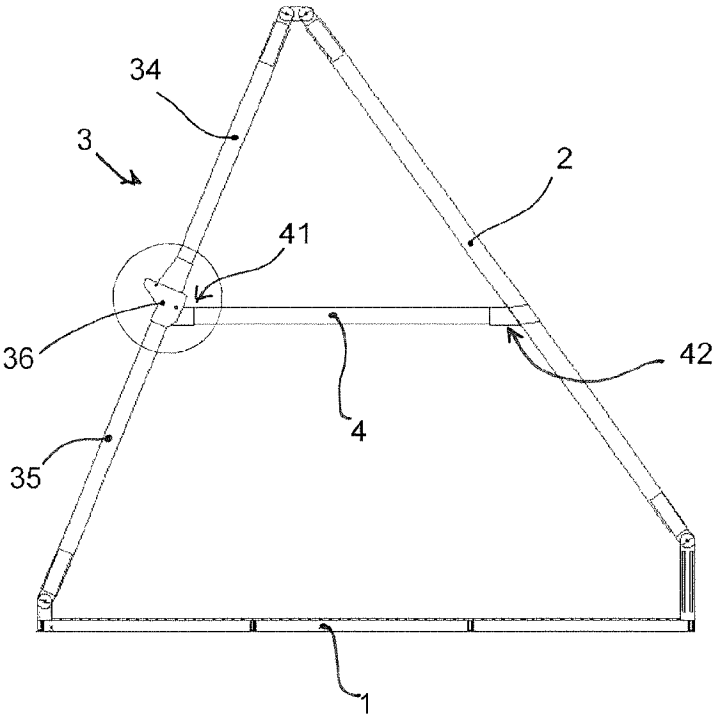
FIG. 6 shows a module (A) with the intermediate plane (4) hinged at the folding hinge (36) of a pitched roof element (3).

In the embodiment of FIGS. 1-3 and in the embodiment of FIG. 6, this intermediate plane (4) is preferably hinged (37) with its short side (41) to the second pitched roof element (3), at the level of the hinges (36) of the two parts (34, 35), which are, for example, a three-way type, as shown in FIG. 9, while it can be constrained to the opposite side (42) of the first pitched roof element (2) through special clamps or blocking means (43), represented for example in FIG. 10.

In the embodiment in FIG. 7, the intermediate plane (4) is hinged with one end or edge (41) to the second pitched roof element (3) in a different point than the hinge (36) of the pitched roof element (3) itself, for example at a lower level, closer to the bottom (1), in order to optimize the distribution of the volume of the living unit (C) obtained, thereby improving the habitability of the upper floor.

In the closed configuration, shown in FIG. 1, the new module (A) has the bottom (1) and first pitched roof element (2) positioned parallel to each other and interposed between them is the folded second pitched roof element (3).

The intermediate plane (4), hinged to the folded pitched roof element (3), and released from the first pitched roof element (2) is also interposed between the first pitched roof element (2) and the bottom (1).

Figure 11:
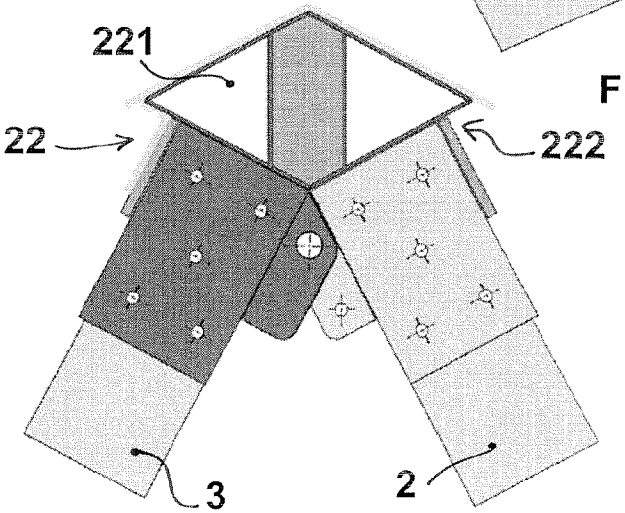

FIG. 11 shows a possible embodiment of the hinge (22) at the top between the pitched roof elements (2, 3), designed so as to also have the function of a ridge (221). As shown in FIG. 11, the ridge (221) is preferably integral with the upper edge of one of the two pitched roof elements (3) and is shaped so that, when the module is open, it also rests on the upper edge of the second pitched roof element (2). To ensure a seal, the invention provides for the use of gaskets (222) or other means interposed between the pitched roof element (2) and the ridge (221).

To attain a closed structure with a compact and storable shape, the first pitched roof element (2) and the bottom (1) are mutually spaced by, for example, a septum or segment (5) integral with the side (11) of the bottom (1) and positioned orthogonally or inclined with respect to the bottom (1) itself, and wherein the first pitched roof element (2) is hinged to the septum or segment (5).

The opening of the module (A) foresees putting the bottom (1) on the supporting plane to form the base of the triangle section (FIG. 1).

In the embodiment of FIGS. 1-3, to open the module (A), it is necessary to lift the first single-piece pitched roof element (2) by rotating it around the hinges (13) with respect to the bottom (1), also unfolding the second pitched roof element (3) (FIG. 2).

The two parts (34, 35) of the second pitched roof element (3) are rotated until they are coplanar to form the second plane pitched roof element (3) (FIG. 3) and the hinges (36) are locked by means of suitable mechanisms. This intermediate plane (4) is then lifted and constrained to the first pitched roof element (2) so as to be parallel to the bottom (1).

In contrast, to close the module (A) the intermediate plane (4) is released and the second folding pitched roof element (3) is folded towards the interior of the triangle so as to rotate the single-piece pitched roof element (2) to bring it close to the bottom (1) until forming a planar structure (FIG. 1) wherein the first pitched roof element (2), the bottom (1) and the panels (34, 35) forming the second pitched roof element (3) are preferably all parallel to each other.

Figure 3A:
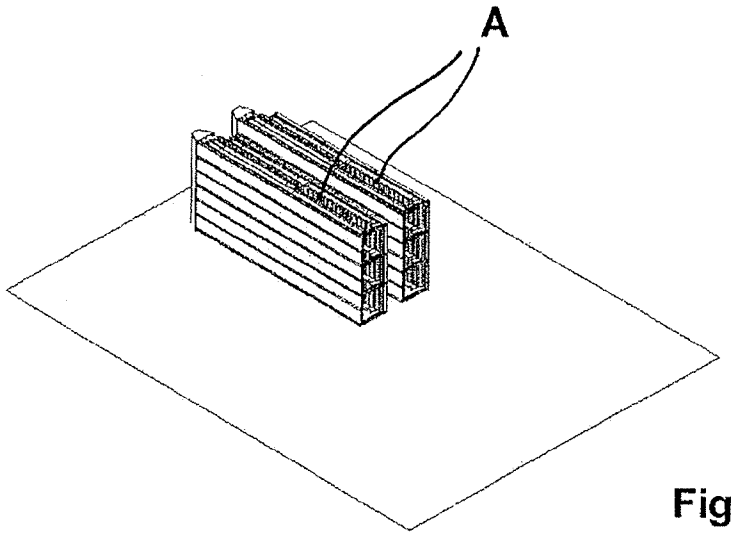
Figure 3B:
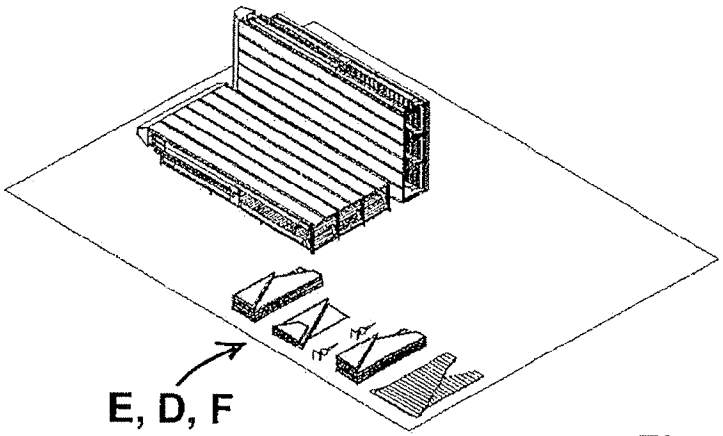
Figure 3C:
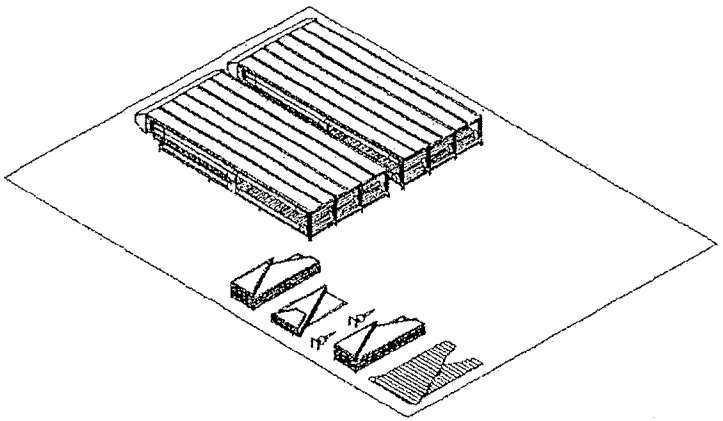
Figure 3D:
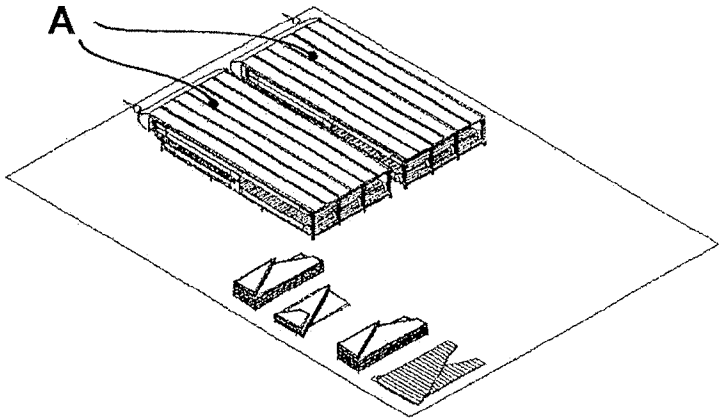
Figure 3E:
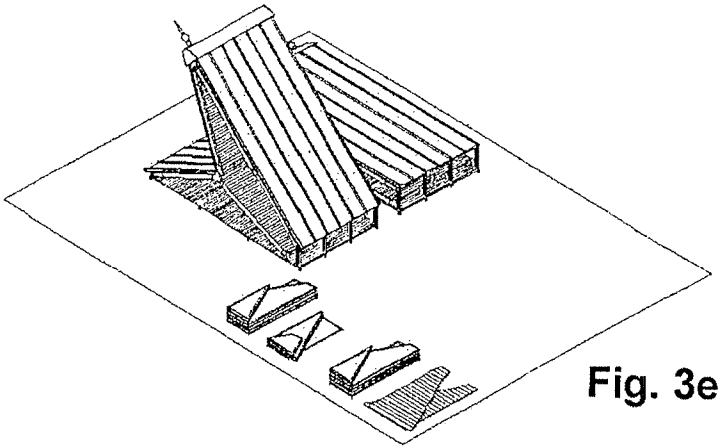
Figure 3F:
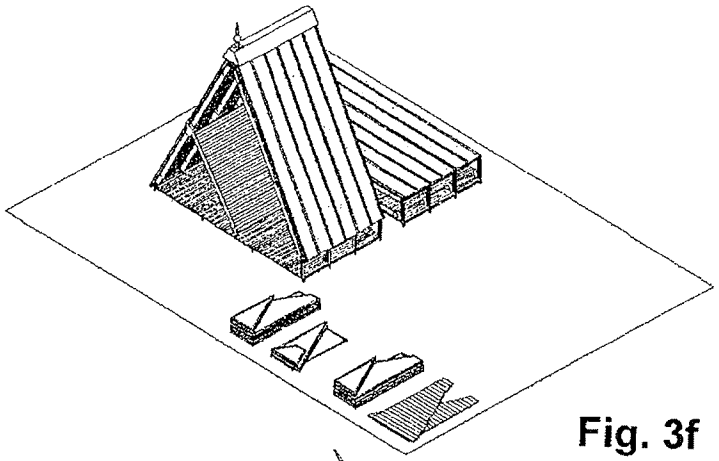
Figure 3G:
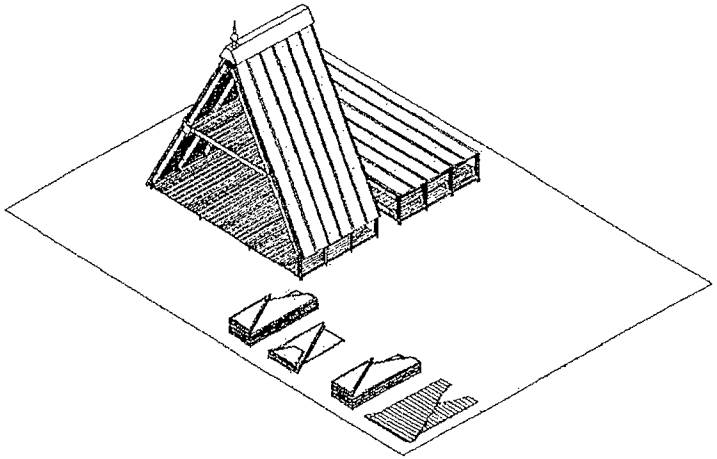
Figure 3H:
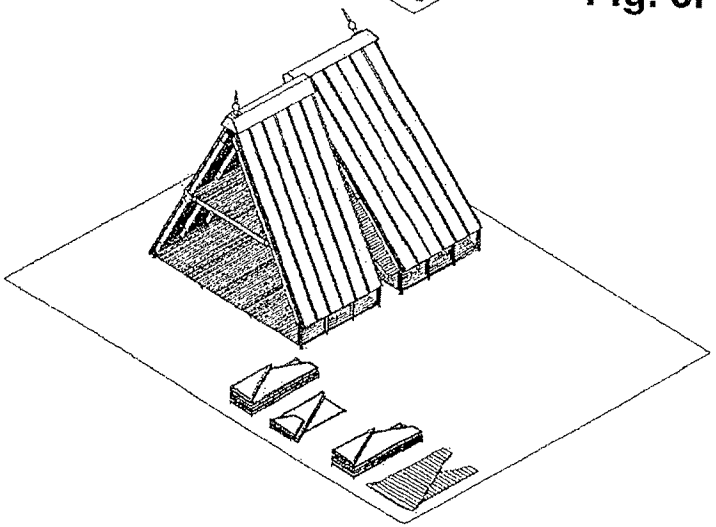
Figure 3I:
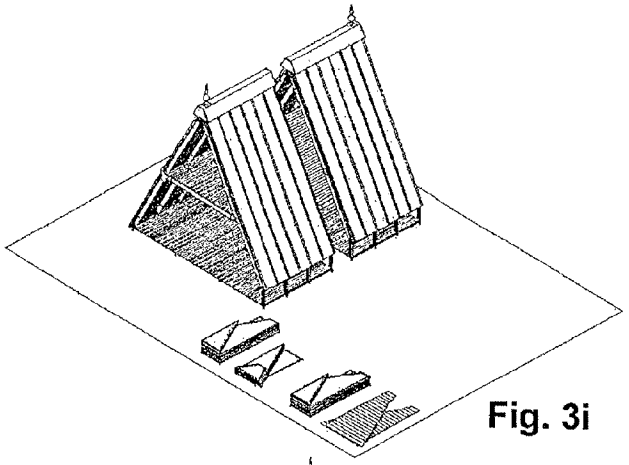
Figure 3L:
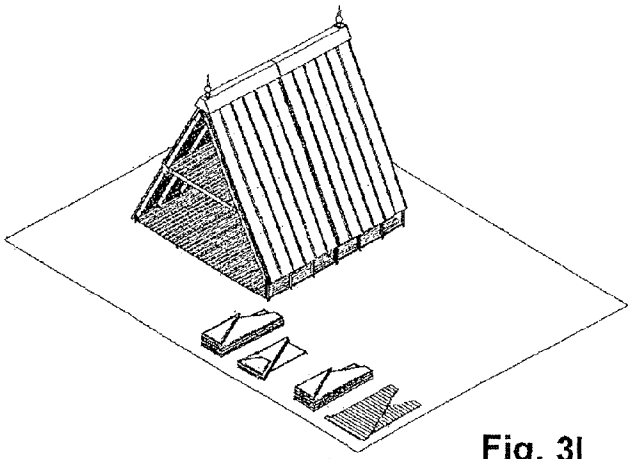
Figure 3M:
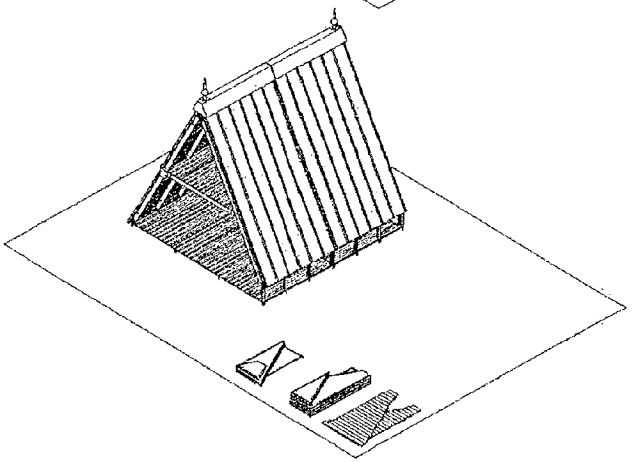
Figure 3N:
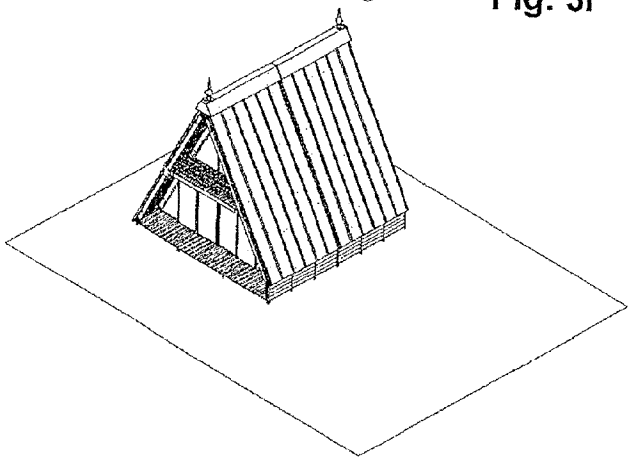

FIGS. 3*a*-3*n* show how it is possible to assemble a living unit from two fan-shaped modules (A) positioned side by side (FIG. 3), then turned over (FIG. 3*d*) and opened (FIG. 3*e*), applying finishing elements at the end.

FIGS. 4.13 and 4.14 show a three-dimensional view of a living unit or building (C) formed by three of these new living modules (A) constrained to each other by fixing means and installable resting directly on a plane in general.

Between two adjacent modules (A) one or more fixing panels (F), decorative and/or windowed in whole or in part, can be installed.

The living unit obtained also comprises two front and back façades (D, E), shown for example in FIG. 8, wherein each façade (D, E) in turn comprises one or more walls, for example in the presence of intermediate floors, upon which doors or windows, balconies, terraces, etc. can be installed.

FIG. 4 shows how it is possible to fold, in the area equivalent to that of a container of the known type, at least two or preferably three of these living modules (A1, Ac, A2) in addition to the elements forming the fixing panels and the two façades (F, D, E).

In this embodiment, the modules (A1, Ac, A2) are joined together and mutually hinged so that they can be positioned to form a compact volume.

Starting from this compact volume, it is possible, as shown in FIGS. 4.1-4.15, to unfold the living unit (C), by simply turning over the side modules (A1, A2) hinged to the central module (Ac) (FIG. 4.5). The modules are then opened one by one (FIG. 4.11), and finally the fixing panels are mounted (F) (FIG. 4.12).

The new living unit (C) can be of the "mobile home" type that is installed on a support carriage (M), with wheels (M1) and/or steer wheels such as a trailer, with hooking systems (M2) for towing, this carriage (M) being integral or removable once the living unit (C) is unfolded and placed in conditions of safety.

Figure 5A:
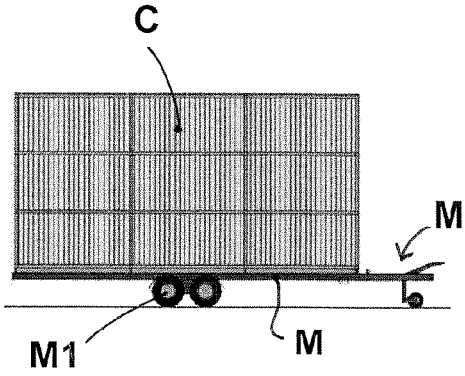
Figure 5B:
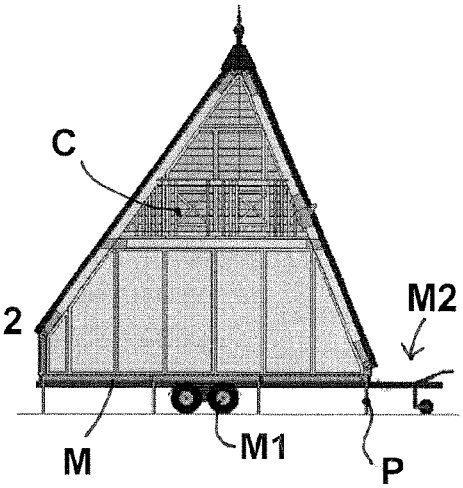
Figure 5C:
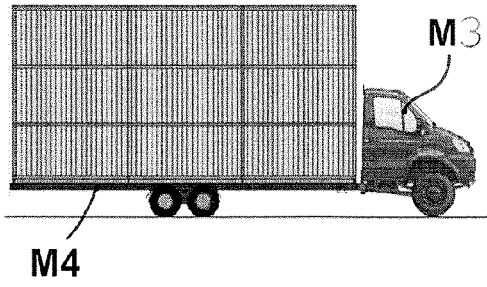
Figure 5D:
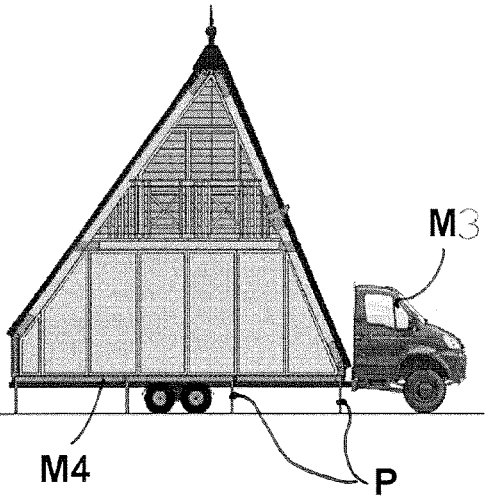

Alternatively, as shown in FIGS. 5*c* and 5*d*, the new living unit (C) may comprise a motor (M3) with a flatbed (M4) integral with the living unit (C) itself or functional only for the transport of the same, that is extractable once the living unit (C) is unfolded and placed in conditions of safety.

In this case, as seen in FIGS. 5.1-5.27, similarly to the embodiment shown in FIGS. 4 and 4.1-4.15, the living unit (C) comprises at least two or preferably three of said modules (A1, Ac, A2) joined together and hinged so as to form a compact volume supported on the carriage (M2) or on the flatbed (M4).

Starting from this compact volume, it is possible to unfold the living unit (C), by simply turning over the side modules (A1, A2) hinged to the central module (Ac), the central module (Acx) resting on said carriage (M) and on any feet (P), while the side modules (A1, A2) are resting on feet (P) (FIG. 5.6). The modules are then opened one by one (FIG. 5.11).

The carriage (M) is integral to the living unit or is removable, leaving the living unit (C) resting only on the feet (P).

To open and close the module (A) pull systems may be used for example ropes, winches or mechanical, pneumatic and/or hydraulic lifting means, or any other technique suitable for use.

FIGS. 7.1-7.6 show for example a rope pull system (T), with a tie rod (T1) stretched between the free end (42) of the intermediate plane (4) and the corresponding end (11) of the bottom (1), and wherein the traction of the tie rod causes the unfolding of the second folding pitched roof element (3) and the lifting of the opposite pitched roof element (2). When the pitched roof elements (2, 3) are completely open, the intermediate plane or beam (4) is lifted, rotating it around its hinge (41) and is finally constrained to the end or opposite edge (42) to the first pitched roof element (2).

Therefore, with reference to the preceding description and the attached drawings, the following claims are made.

The invention claimed is:

1. A modular living unit (C) comprising:

one or more modules (A) having a folded configuration and an unfolded configuration, wherein each module (A) comprises:

a folding and collapsible structure comprising two adjacent rigid sides or walls (1, 2), hinged to each other through a hinge or a fixed knot (13), and a third side or wall (3), hinged to said two rigid sides or walls (1, 2), wherein said third side or wall (3) is unfoldable, such that the module is opened by rotating the two rigid sides (1, 2) around said hinge (13) and by unfolding said third side (3), causing said module to assume the unfolded configuration with a prismatic shape with a substantially triangular section, wherein said third side or wall (3) is foldable towards an interior between said two rigid sides, by causing the two rigid sides (1, 2) to rotate around the fixed hinge (13) until said two rigid sides become parallel to each other and side by side, and said module assumes, the folded configuration with a substantially plane shape;

wherein a first one (2) of said two adjacent rigid sides or walls provides a plane bottom of the module (1) in the unfolded configuration, said plane bottom having a substantially rectangular shape with two longer sides that determine a width of the module, and two shorter sides that determine a length of the module, wherein a second one (3) of said two adjacent rigid sides or walls provides a first pitched roof element of the module in the unfolded configuration, said first pitched roof element having a substantially rectangular shape that is directly or indirectly hinged to one of the two shorter sides (11) of said bottom (1) through hinges (13) having a rotation axis parallel to said one of the two shorter sides (11) of said bottom, wherein said third side provides a second pitched roof element of said module in the unfolded configuration, said second pitched roof element having a substantially rectangular shape with a first shorter side (31) hinged to a shorter side (21) of said first pitched roof element (2) and a second shorter side (32) hinged to one of the two shorter sides (14) of said bottom (1), through hinges (22, 33) having a rotation axis parallel to the shorter sides (31, 32) of said second pitched roof element, wherein said second pitched roof element (3 is divided along its height into at least two plane parts (34, 35) hinged to each other along hinges (36) parallel to said shorter sides (31, 32) of said second pitched roof element; and at least one intermediate plane (4) that divides the module (A) in the unfolded configuration along its height, said intermediate plane (4) having shorter sides and longer sides, wherein said intermediate plane (4) is hinged with a first one of its shorter sides (41) to said second pitched roof element (3), and a second one of its shorter sides (42) is configured to be constrained to said first pitched roof element (2) through a locking system (43), wherein, in the folded configuration of said module, said bottom (1) and said first pitched roof element (2) are positioned parallel to each other, and said second pitched roof element (3) and said intermediate plane (4) are interposed therebetween, said second pitched roof elements (3) being folded, and said intermediate plane (4) having one end hinged to said folded pitched roof element (3) and an opposite end released from said first pitched roof element (2).

2. The modular living unit according to claim 1, wherein said at least one intermediate plane (4) is hinged to said second pitched roof element (3) at said hinges (36) between said at least two parts (34, 35) of said second pitched roof element.

3. The modular living unit according to claim 1, wherein said at least one intermediate plane (4) is hinged to said second pitched roof element (3) in a different position with respect to said hinges (36) between said at least two parts (34, 35) of said second pitched roof element.

4. The modular living unit according to claim 1, wherein said two adjacent rigid sides or walls (1, 2 and said third side or wall (3) comprise beams (1, 2, 3, 4) forming a frame, and infill panels.

5. The modular living unit according to claim 1, further comprising a partition or section (5) integrally coupled to a side (11) of said bottom (1) and positioned orthogonally or inclined with respect to the bottom (1), said partition or section being configured to space said first pitched roof element (2) and said bottom (1).

6. The modular living unit according claim 1, wherein two or more of said modules (A) are provided, each adjacent and constrained to each other through a fixing system, and wherein one or more decorative, fixing, or assembly panels (F), fully or partially windowed elements, or solar panels are mounted between two side-by-side modules (A) or on said first or second pitched roof elements (2, 3).

7. The modular living unit according claim 1, further comprising two or more modules (A1, Ac, A2) hinged to each other, wherein unfolding said modular unit comprises overturning one or more of said modules (A1, A2) and unfolding each one of them.

8. The modular living unit according to claim 7, further comprising a lower supporting carriage (M) suited to support the living unit (C) in both the folded and the unfolded configuration, and feet (P) supporting said unfolded modules (A1, Ac, A2).

9. The unfoldable modular living unit according to claim 8, wherein said carriage (M) comprises steering or non-steering transport wheels (M1), and hooking systems (M2) for towing, said carriage (M) being integral with said living unit or suited to be pulled out once the living unit has been completely unfolded.

10. The unfoldable modular living unit according to claim 7, further comprising a motor (M3) with a flatbed (M4) suited to support two or more modules forming the modular living unit in both the folded and the unfolded configuration, said flatbed (M4) being integral with said modular living unit or suited to be pulled out once the modular living unit has been completely unfolded.

* * * * *